US007595086B2

(12) United States Patent
Kohler

(10) Patent No.: US 7,595,086 B2
(45) Date of Patent: Sep. 29, 2009

(54) METHOD FOR PRODUCING CORRUGATED CARDBOARD

(76) Inventor: Herbert B. Kohler, 10995 Wright Rd., NW., Uniontown, OH (US) 44685

( * ) Notice: Subject to any disclaimer, the term of this patent is extended or adjusted under 35 U.S.C. 154(b) by 562 days.

(21) Appl. No.: 11/259,794

(22) Filed: Oct. 27, 2005

(65) Prior Publication Data

US 2007/0098887 A1 May 3, 2007

(51) Int. Cl.
*B05D 5/10* (2006.01)
*B05D 1/28* (2006.01)
*B05C 1/08* (2006.01)

(52) U.S. Cl. ..... 427/207.1; 427/428.01; 427/428.11; 427/428.12; 118/200; 118/244; 118/246; 118/248

(58) Field of Classification Search ..... 118/200, 118/244, 246, 248, 249; 427/207.1, 428.01, 427/428.11, 428.12
See application file for complete search history.

(56) References Cited

U.S. PATENT DOCUMENTS

| | | | | |
|---|---|---|---|---|
| 1,981,338 | A | 11/1934 | Swift Jr. | |
| 2,398,844 | A | 4/1946 | Muggleton et al. | |
| 2,622,558 | A | 12/1952 | Mikkelsen | |
| 3,026,231 | A | 3/1962 | Chavannes | |
| 3,046,935 | A | 7/1962 | Wilson | |
| 3,300,359 | A * | 1/1967 | Nikkel | 156/292 |
| 3,306,805 | A | 2/1967 | Klein et al. | |
| 3,560,310 | A | 2/1971 | Bolton | |
| 3,648,913 | A | 3/1972 | Ferara | |
| 3,788,515 | A | 1/1974 | Middleman | |
| 4,086,116 | A | 4/1978 | Yazaki et al. | |
| 4,177,102 | A | 12/1979 | Tokuno | |
| 4,267,008 | A | 5/1981 | Owens | |
| 4,306,932 | A | 12/1981 | Bradatsch et al. | |
| 4,316,428 | A | 2/1982 | Flaum et al. | |
| 4,316,755 | A | 2/1982 | Flaum et al. | |

(Continued)

FOREIGN PATENT DOCUMENTS

| | | |
|---|---|---|
| CA | 1072873 | 3/1980 |

(Continued)

OTHER PUBLICATIONS

International Preliminary Report on Patentability for corresponding International Application No. PCT/US2006/035474, dated May 8, 2008.

(Continued)

*Primary Examiner*—Timothy H Meeks
*Assistant Examiner*—Cachet I Sellman
(74) *Attorney, Agent, or Firm*—Pearne & Gordon LLP

(57) ABSTRACT

A method is provided for applying adhesive to the flutes of a corrugated sheet web. An applicator roll is provided with a uniform thin coating of adhesive by a metering rod. Exposed crests of the flutes are brought into contact with a coating of adhesive that has been applied to a surface of an applicator roll in order to provide a uniform bead of adhesive on the flute crests. The flutes are compressed against the applicator roll surface in a forward direction relative to the direction in which the web is moving adjacent the applicator roll surface. In one embodiment, the applicator roll has a surface linear velocity greater than the speed at which the web is traveling.

29 Claims, 6 Drawing Sheets

U.S. PATENT DOCUMENTS

| | | | | | |
|---|---|---|---|---|---|
| 4,338,154 | A | | 7/1982 | Berthelot et al. | |
| 4,344,379 | A | | 8/1982 | Roberts | |
| 4,351,264 | A | | 9/1982 | Flaum et al. | |
| 4,453,465 | A | | 6/1984 | Heller et al. | |
| 4,544,436 | A | | 10/1985 | Itoh et al. | |
| 4,569,864 | A | * | 2/1986 | McIntyre | 427/207.1 |
| 4,589,944 | A | | 5/1986 | Torti et al. | |
| 4,603,654 | A | | 8/1986 | Mori et al. | |
| 4,757,782 | A | | 7/1988 | Pullinen | |
| 4,764,236 | A | | 8/1988 | Nikkel | |
| 4,841,317 | A | | 6/1989 | Westell | |
| 4,863,087 | A | | 9/1989 | Kohler | |
| 4,871,593 | A | * | 10/1989 | McIntyre | 427/207.1 |
| 4,886,563 | A | | 12/1989 | Bennett et al. | |
| 4,935,082 | A | | 6/1990 | Bennett et al. | |
| 4,991,787 | A | | 2/1991 | Berg | |
| 5,016,801 | A | | 5/1991 | Gilat et al. | |
| 5,037,665 | A | | 8/1991 | LaMantia et al. | |
| 5,048,453 | A | | 9/1991 | Eriksson | |
| 5,103,732 | A | | 4/1992 | Wells et al. | |
| 5,203,935 | A | | 4/1993 | May et al. | |
| 5,226,577 | A | | 7/1993 | Kohler | |
| 5,242,525 | A | | 9/1993 | Biagiotti | |
| 5,246,497 | A | | 9/1993 | Rantanen | |
| 5,275,657 | A | | 1/1994 | Duffy et al. | |
| 5,362,346 | A | | 11/1994 | Bullock, Sr. | |
| 5,503,547 | A | | 4/1996 | Funahashi et al. | |
| 5,508,083 | A | | 4/1996 | Chapman, Jr. | |
| 5,660,631 | A | | 8/1997 | Eriksson | |
| 5,783,006 | A | | 7/1998 | Klockenkemper et al. | |
| 6,051,068 | A | | 4/2000 | Kohl et al. | |
| 6,058,844 | A | | 5/2000 | Niemiec | |
| 6,068,701 | A | * | 5/2000 | Kohler et al. | 118/249 |
| 6,098,687 | A | | 8/2000 | Ishibuchi et al. | |
| 6,126,750 | A | | 10/2000 | Seiz et al. | |
| 6,136,417 | A | | 10/2000 | Ishibuchi et al. | |
| 6,257,520 | B1 | | 7/2001 | Fujikura | |
| 6,364,247 | B1 | | 4/2002 | Polkinghorne | |
| 6,418,851 | B1 | | 7/2002 | Hartmann et al. | |
| 6,470,294 | B1 | | 10/2002 | Taylor | |
| 6,575,399 | B1 | | 6/2003 | Lamothe | |
| 6,595,465 | B2 | | 7/2003 | Lamothe | |
| 6,602,546 | B1 | * | 8/2003 | Kohler | 427/207.1 |
| 6,620,240 | B2 | * | 9/2003 | Choi et al. | 118/249 |
| 6,620,455 | B2 | | 9/2003 | Mensing et al. | |
| 6,635,111 | B1 | | 10/2003 | Holtmann et al. | |
| 6,692,602 | B1 | * | 2/2004 | Mensing et al. | 156/205 |
| 7,267,153 | B2 | | 9/2007 | Kohler | |
| 2002/0149866 | A1 | | 10/2002 | Kato et al. | |
| 2003/0178524 | A1 | | 9/2003 | Newman et al. | |
| 2005/0194088 | A1 | | 9/2005 | Kohler | |
| 2006/0225830 | A1 | | 10/2006 | Kohler | |
| 2007/0261793 | A1 | | 11/2007 | Kohler | |

FOREIGN PATENT DOCUMENTS

| | | | |
|---|---|---|---|
| DE | 4018426 | | 12/1991 |
| EP | 0037332 | | 10/1981 |
| EP | 0825017 | | 2/1998 |
| JP | S56-160832 | A | 11/1981 |
| JP | H10-034776 | A | 2/1998 |
| JP | 2000202930 | | 7/2000 |

OTHER PUBLICATIONS

E. Daub, "Gluing corrugating medium and linerboard together on the corrugator," Tappi Journal, Jun. 1990, pp. 171-178.

Clyde H. Sprague, "Development of a Cold Corrugating Process Final Report," The Institute of Paper Chemistry, of the Office of Industrial Programs, U.S. Department of Energy, May 1985 (total of 718 pages for Sections I-V).

William O. Kroeschell, "Bonding on the corrugator," Tappi Journal, Feb. 1990, pp. 69-74.

Ononokpono et al., "The influence of binder film thickness on the mechanical properties of binder films in tension," J. Pharm Pharmacol., Feb. 1988, pp. 126-128.

M. Inoue et al., "Kinetics of Gelatinization of Cornstarch Adhesive," J. of Applied Polymer Science, 1986, pp. 2779-2789, vol. 31.

Raymond L. Janes, "A Study of Adhesion in the Cellulose-Starch-Cellulose System," The Institute of Paper Chemistry, Jun. 1968, Appleton, WI.

"Development of a Cold Corrugating Process," Contract No. DE-AC02-79CS40211, The Institute of Paper Chemistry, Dec. 15, 1981, Appleton, WI.

Prosecution history for U.S. Appl. No. 11/279,347, retrieved from PAIR on Dec. 16, 2008.

* cited by examiner

Fig.3
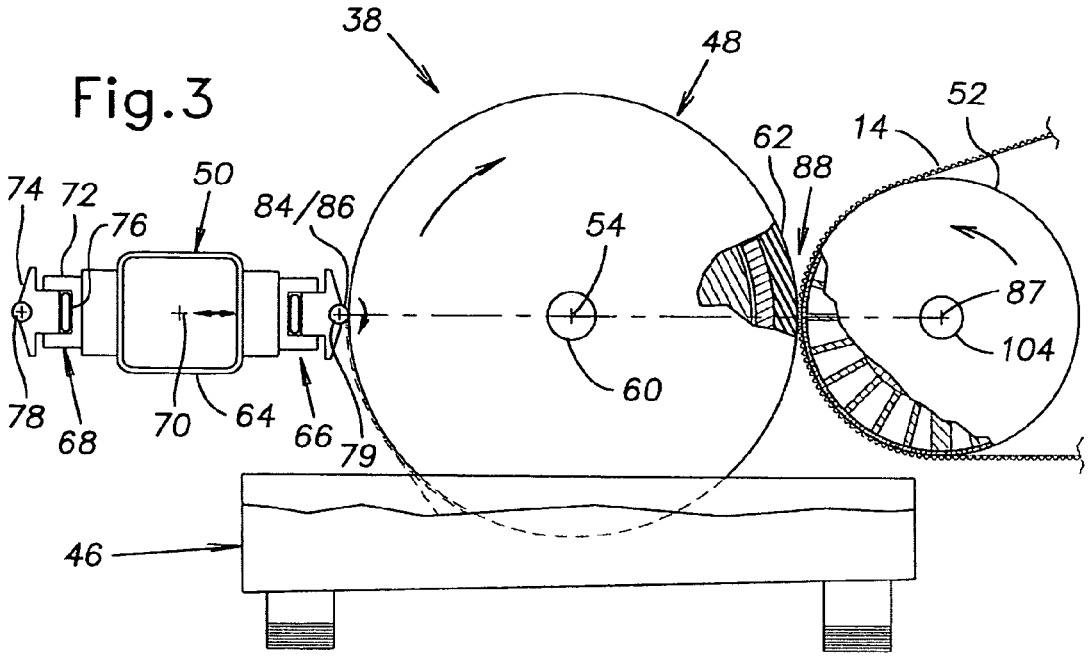
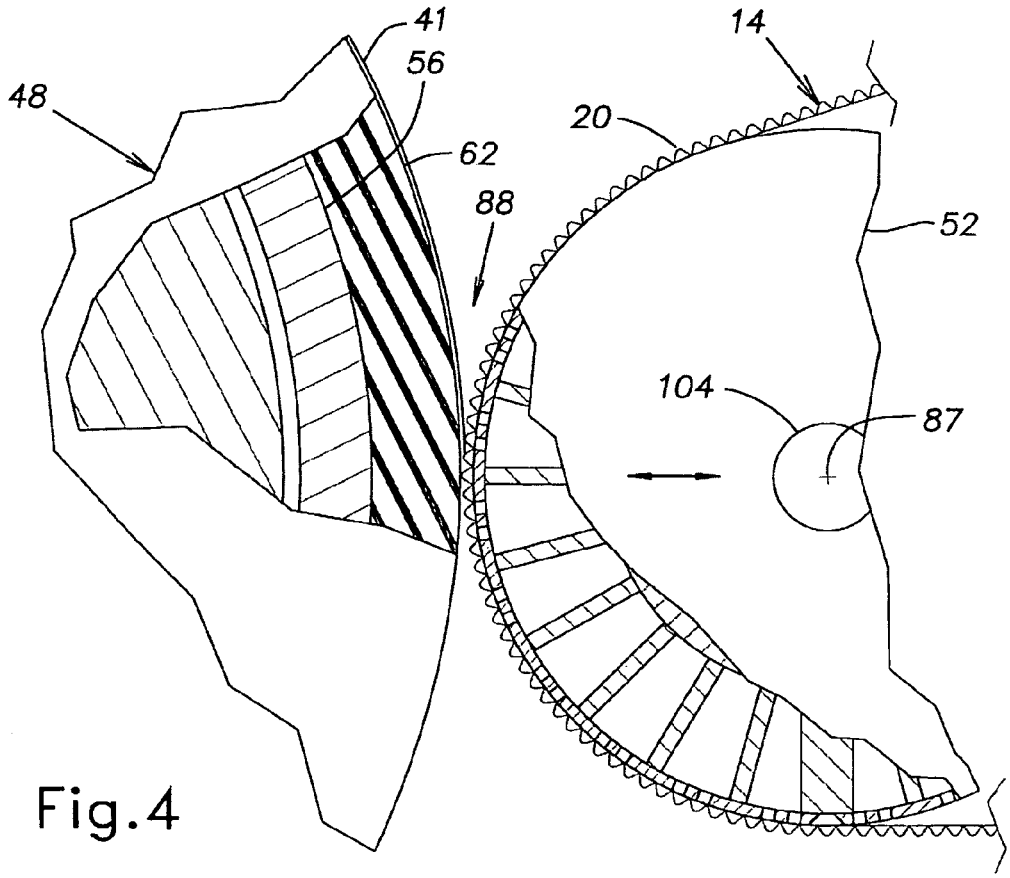
Fig.4

METHOD FOR PRODUCING CORRUGATED CARDBOARD

BACKGROUND OF THE INVENTION

The present invention generally relates to the production of corrugated cardboard, and more particularly to a novel and improved method for accurately applying an adhesive to the flutes of corrugated board centered on the flute crests, so that the flutes can be bonded to a face.

Typically, corrugated cardboard is formed by producing a corrugated sheet which is initially bonded along one side to a single face. Adhesive is then applied to the crests of the flutes remote from the single face by an applicator roll of a glue machine. Thereafter, a second face is applied to the adhesive on the flutes to produce a composite structure in which corrugations extend between and are bonded to spaced-apart faces.

In some instances, multiple-layer cardboard is produced in which more than one corrugated sheet is adhesively attached to additional faces so that, for example, a central flat face is bonded to a corrugated sheet on each side thereof, and outer flat faces are bonded to the sides of the two corrugated sheets remote from the central face.

The corrugated sheet is typically passed between a rider roll and an applicator roll to apply the adhesive to the flutes. The rider roll typically applies sufficient downward pressure to force the flute tips into contact with the applicator roll. This downward pressure causes compression or deformation of the flutes. The flutes enter the adhesive layer prior to being crushed against the applicator and often become overly wetted or saturated with adhesive due to the long dwell time. As a result, the flutes do not return to their original shape after being crushed. This permanent deformation of the flutes reduces the strength of the final cardboard.

It has been known in the art that glue machines can be run with the applicator roll operating at a lower speed than the web speed (speed at which the corrugated sheet passes between the applicator roll and the rider roll) in order to adjust glue weight. U.S. Pat. No. 6,602,546, incorporated herein by reference, discloses a method for operating a glue machine such that the applicator roll can be operated at speed lower than the web speed while still applying a uniformly thick glue line at the flute crests, minimizing glue application along the leading or trailing faces of the flutes.

Previously, it was believed that the applicator roll must always be operated at a lower speed than the web speed. However, it has been discovered, surprisingly and unexpectedly, that excellent glue weight control and reproducibility also can be achieved when the applicator roll is operated at a speed (surface linear speed) greater than the web speed, e.g. at least 105% of the web speed

BRIEF SUMMARY OF THE INVENTION

The present invention provides a method and apparatus for uniformly and accurately applying adhesive to the crests of the flutes of corrugated sheets with little or no (or substantially no) adhesive being applied to either the leading or trailing sloped faces of the flutes. In accordance with the present invention, higher line speeds can be achieved, tighter performance specifications exceeding the capability of the industry's standard machines are possible, and a significant reduction in the amount of glue used is achieved. In addition, accurately centering the adhesive onto the crests of the flutes provides stronger bond strength between the corrugated sheet and the adhered-to face sheet. Directional differences in strength are minimized or substantially eliminated, and surface smoothness of the face sheets is improved (washboarding reduced). Because the adhesive is very accurately deposited only to the flute crests, it is possible to reduce the adhesive weight deposition rate about 10-70% of that required in conventional machines while delivering the same or comparable bond and crush strength. Furthermore, in accordance with the present invention, smoother and more printable boards with greatly reduced warpage and improved surface finish are produced.

A method of applying adhesive to flutes of a corrugated sheet is provided, wherein each flute has a leading sloped face, a trailing sloped face and a crest. The method includes the following steps: a) applying a layer of adhesive on an outer surface of an applicator roll and rotating the applicator roll in a first direction; and b) moving the corrugated sheet along a path adjacent the outer surface of the applicator roll to apply adhesive to the flutes from the layer of adhesive; wherein a roll speed ratio is defined as the ratio of the surface linear velocity of the applicator roll to the speed at which the corrugated sheet is moving, and the roll speed ratio is greater than 1.

A further method of applying adhesive to flutes of a corrugated sheet is provided, wherein each flute has a leading sloped face, a trailing sloped face and a crest therebetween. The method includes the following steps: a) applying a layer of adhesive on an outer surface of an applicator roll and rotating the applicator roll in a first direction; b) moving the corrugated sheet along a path adjacent the outer surface of the applicator roll to apply adhesive to the flutes from the layer of adhesive; and c) initially contacting each of the flutes with the applicator roll such that the crest of each of the flutes is compressed in a forward direction relative to the direction in which the corrugated sheet is moving along the path adjacent the outer surface of the applicator roll.

BRIEF DESCRIPTION OF THE SEVERAL VIEWS OF THE DRAWING

These and further features of the present invention will be apparent with reference to the following description and drawings, wherein:

FIG. 3 is an enlarged fragmentary view, partially in cross-section, showing a portion of the machine of FIG. 1 at a glue mechanism for applying adhesive to crests of a single faced corrugation assembly;

FIG. 4 is an enlarged fragmentary view, partially in cross-section, showing a portion of the glue mechanism of FIG. 3 at an interface between an applicator roll and a vacuum rider roll;

DETAILED DESCRIPTION OF PREFERRED EMBODIMENTS

As used herein, the terms 'glue' and 'adhesive' are used interchangeably, and refer to the adhesive that is applied to the flute crests of a corrugated sheet 18 according to the invention as hereinafter described. Also as used herein, the term 'web' refers to the corrugated sheet 18 traveling through a glue machine 38, and particularly as it travels past an applicator roll 48 for applying adhesive thereto as will be further described. In the description that follows, and from the drawings, it will be apparent that the web speed is controlled, at least in part, by the rotational speed of the rider roll 52.

Figure 1:
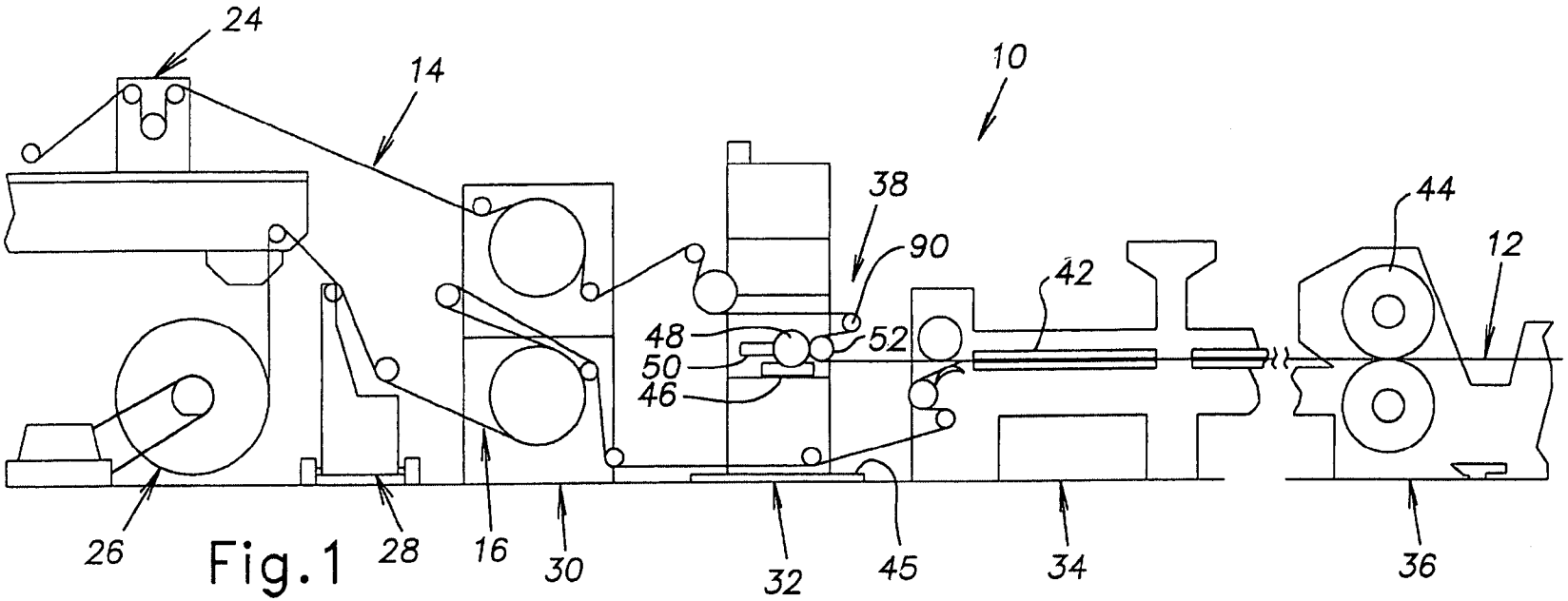
FIG. 1 is a schematic elevational view of a machine for producing cardboard in accordance with the present invention.
Figure 2C:
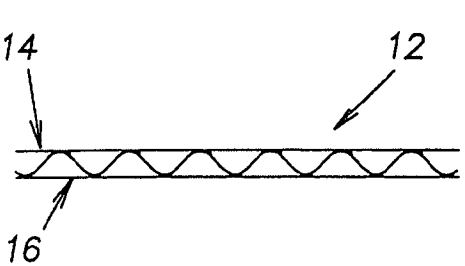
FIG. 2C is an elevational view of the single face corrugated sheet of FIG. 2A with a second face secured thereto.
Figure 2B:
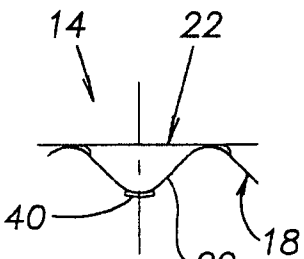
FIG. 2B is an enlarged elevational view of the single face corrugated sheet of FIG. 2A with adhesive applied to the crests of the flutes.
Figure 2A:
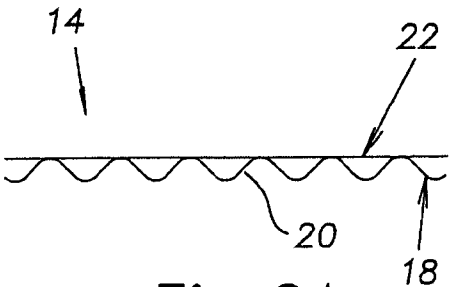
FIG. 2A is an enlarged elevation view of a single face corrugated sheet.

FIG. 1 schematically illustrates a machine 10 for producing single-corrugated cardboard sheet 12. As best shown in FIGS. 2A, 2B, and 2C, the single-corrugated cardboard sheet 12 is produced by joining a web of single-face corrugation assembly 14 with a face sheet 16. The single-face corrugation assembly 14 includes a corrugated sheet 18 having a plurality of flutes 20 and a first face sheet 22 bonded to the crests or tips of the flutes 20 on a first side of the corrugated sheet 18. The crests or tips of the flutes 20 on the second side of the corrugated sheet 18, remote from the attached first face sheet 22, are exposed.

It should be understood that the illustrated machine 10 is shown only by way of example and that the present invention can be applied to many different types of machines. For example, the present invention can be easily utilized with machines for producing double-corrugated cardboard or triple corrugated cardboard, as well as for applying the corrugated sheet 18 to the first face sheet 22.

The machine 10 preferably includes a source 24 of the single-face corrugation assembly 14, a source 26 of the second face sheet 16, a coating station 28 for the second face sheet 16, a pre-heating station 30 for heating the corrugation assembly 14 and the second face sheet 16, a gluing station 32 for applying glue to the corrugation assembly 14, a curing station 34 for joining the corrugation assembly 14 and the second face sheet 16, and a traction station 36 for pulling the finished corrugated cardboard sheet 12 through the machine 10.

The web of the single-face corrugation assembly 14 is supplied to the machine 10 from a source 24 such as, for example, a single facing machine. The source 24 of the corrugation assembly 14 can be of any conventional type. The second face sheet 16 is supplied from a source 26 such as, for example, a supply roll.

From the source 26, the second face sheet 16 passes to the coating station 28. The coating station 28 includes a coating machine for applying a coating to one side of the second face sheet 16. The coating station 28 is not essential to the present invention and is merely illustrated as one available processing apparatus that can be incorporated into the machine 10, particularly where at least one side of the cardboard sheet 12 is to be provided with printing and/or a decorative finish.

Next, the corrugation assembly 14 and the second face sheet 16 both pass through the pre-heating station 30. The pre-heating station 30 includes a heating machine for pre-heating the corrugation assembly 14 and the second face sheet 16. The pre-heating station 30 also is optional depending upon the type of adhesive being applied to the corrugation assembly 14 to join the second face sheet 16.

From the pre-heating station 30, the single-face corrugation assembly 14 passes to the gluing station 32. The gluing station 32 includes a precision glue machine 38 in accordance with the present invention. The glue machine 38 applies an accurately controlled amount of adhesive 40 (best shown in FIG. 2B) to the crests of the flutes 20 as described in more detail hereinafter.

Next, the corrugation assembly 14 and the second face sheet 16 both pass through the curing station 34. The curing station 34 includes a "double facer" which brings the single-face corrugation assembly 14 and the second face sheet 16 together. The double facer can be of any conventional type. Once brought together, the single-face corrugation assembly 14 and the second face sheet 16 pass between guide plates 42 which maintain the assembly flat and straight as the adhesive 40 cures. Additionally, heat can be applied to the plate to aid in the curing of the adhesive.

From the curing station 34, the glued and dried cardboard sheet 12, including the two face sheets 16, 22 bonded to opposite sides of the corrugated sheet 18, passes to the traction station 36. The traction station 36 includes drive and traction rollers 44 which pull the cardboard sheet 12 from the machine 10.

As best shown in FIG. 3, the glue machine 38 includes a glue tray 46, a glue applicator roll 48, an isobar assembly 50, and a rider roll 52. The glue tray 46 is a container having an open top which when filled with glue provides a source or supply of adhesive. The glue tray 46 is located directly below the applicator roll 48 and extends below at least a portion of each of the isobar assembly 50 and the rider roll 52.

The applicator roll 48 is journaled for rotation about a horizontal and transverse rotational axis 54 in the direction indicated by the arrow (clockwise as viewed in FIG. 3). The applicator roll 48 is located above the glue tray 46 and positioned so the lower portion of the applicator roll 48 is immersed in the adhesive within the glue tray 46 at a coating position of the roll 48. As the applicator roll 48 rotates, a coating of adhesive is applied to the periphery of the applicator roll 48 at the coating position. As the surface of the applicator roll 48 emerges from the adhesive within the glue tray 46, a coating of adhesive exceeding the desired final coating or film thickness adheres to the outer peripheral surface of the roll 48.

Figure 4A:
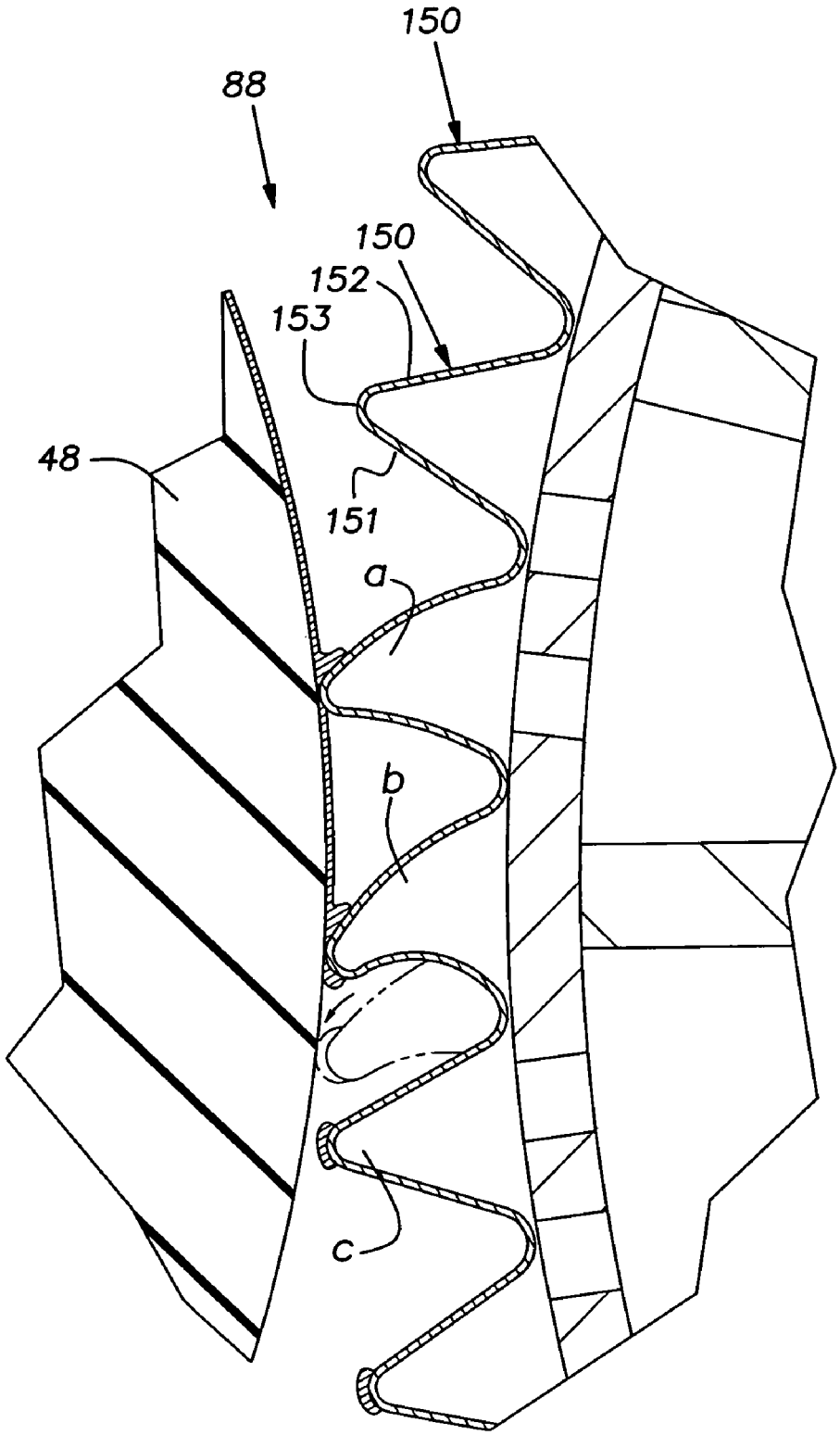
FIG. 4A is an enlarged view as in FIG. 4, showing glue being applied to the flute crests of a corrugated sheet along a path between the applicator roll and the rider roll according to a preferred method of the invention.
Figure 8:
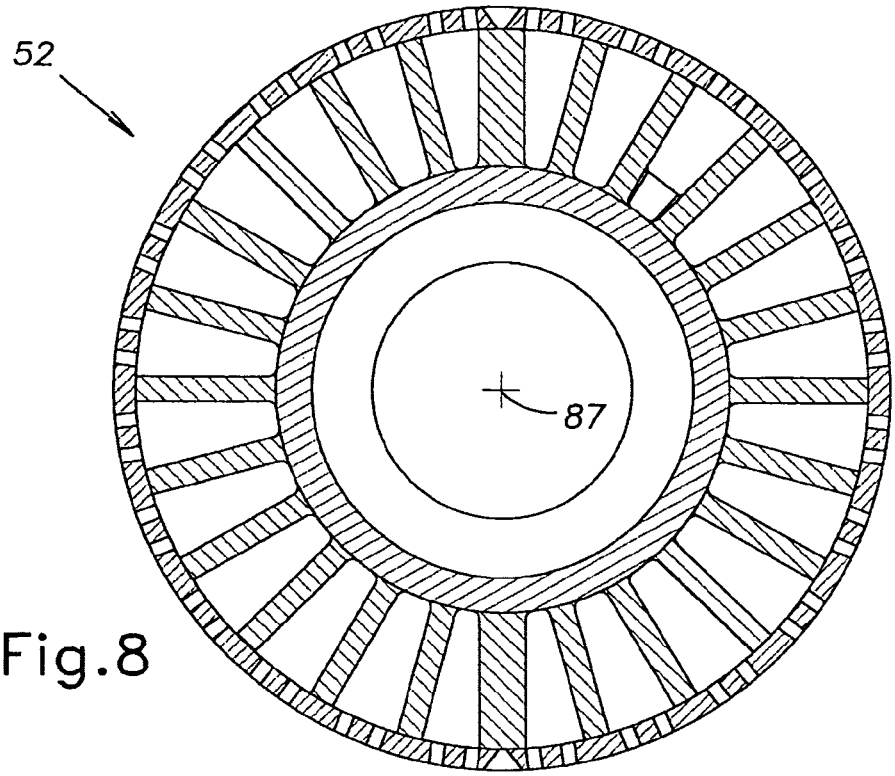
FIG. 8 is a cross-sectional end view of the vacuum rider roll of FIGS. 3 and 4.
Figure 5:
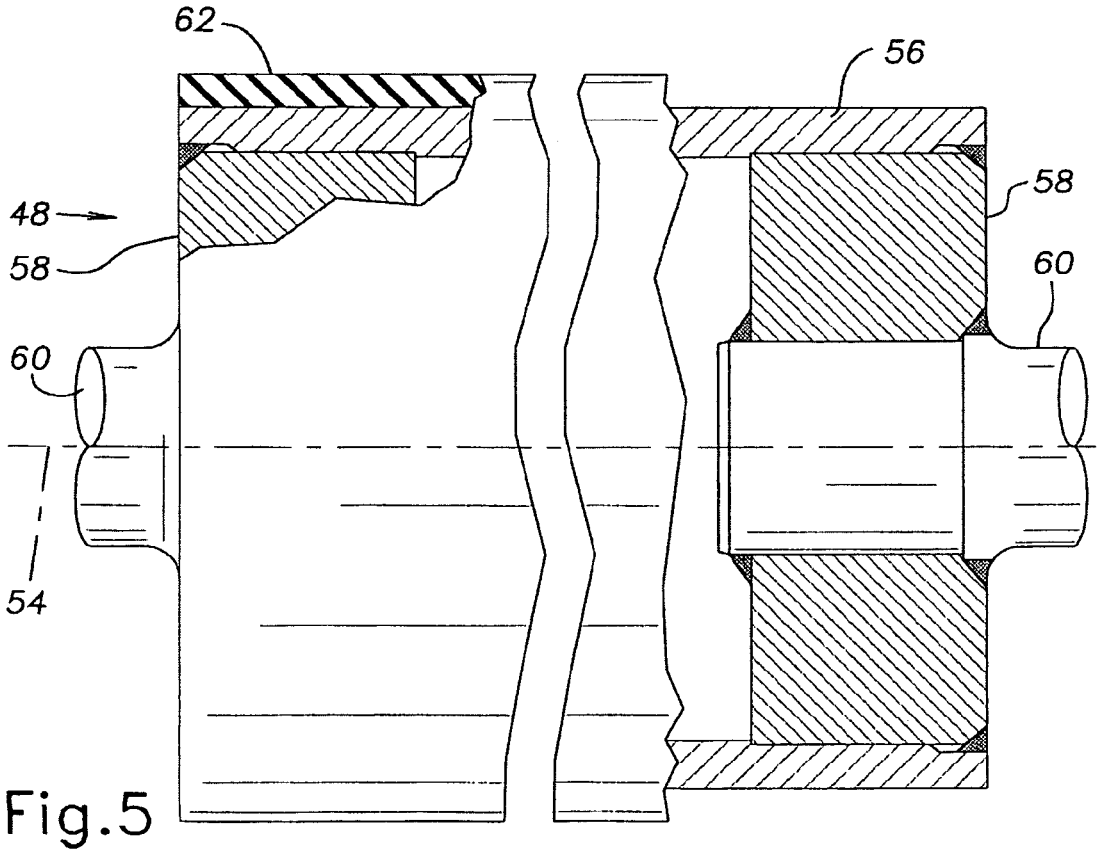
FIG. 5 is a fragmentary side view, partially in cross-section, of the applicator roll of FIGS. 3 and 4.

As best shown in FIGS. 4 and 5, the applicator roll 48 preferably has an outer shell 56, a pair of end plates 58, and a pair of support shafts 60. The outer shell 56 is cylindrically-shaped and formed from a suitable metal. The end plates 58 are secured to opposite ends of the shell 56 in any suitable manner such as, for example, by welding. The support shafts 60 are secured to the end plates 58 at the rotational axis 54 so that the end plates 58 connect the support shafts 60 to the outer shell 56. The shafts 60 are secured to the end plates 58 in any suitable manner such as, for example, by welding. A coating 62 can be applied to the outer peripheral surface of the cylindrical shell 56 and provides a smooth peripheral contact surface of the applicator roll 48. The coating 62 is of any suitable material such as, for example rubber and preferably has a hardness in the range of 0 to 5 P & J hardness. The coating 62 is preferably provided with an extremely smooth surface finish.

The isobar assembly 50 is mounted adjacent to the periphery of the applicator roll 48 and removes excess adhesive from the outer peripheral surface of the applicator roll 48 to provide an adhesive coating 41 having precise uniform thickness on the outer peripheral surface of the applicator roll 48 after it has rotated past the isobar assembly 50. The most preferred thickness of the adhesive coating 41 depends on the size of the flutes to which the glue is to be applied. Table 1 below shows the most preferred adhesive coating 41 thicknesses for different size flutes. The A, B, C, and E flutes listed in table 1 refer to standard flute sizes well known in the corrugated board art by their respective letter designations. Alternatively, the adhesive coating thickness is preferably at least 0.002, 0.003, 0.004, 0.005, or 0.006, inches.

TABLE 1

Preferred thickness of adhesive coating on outer surface of applicator roll for different sized flutes

| Flute Size | Adhesive Coating Thickness (inches) |
|---|---|
| A | 0.008 or less, preferably 0.006-0.008 |
| B | 0.006 or less, preferably 0.003-0.006 |
| C | 0.006 or less, preferably 0.003-0.006 |
| E | 0.006 or less, preferably 0.003-0.006 |
| Smaller than E | 0.004 or less, preferably 0.001-0.003 |

Preferably, the isobar assembly 50 is located at the rear side of the applicator roll 48 (opposite the rider roll 52) and at the same height as the rotational axis 54 of the applicator roll 48, that is, the isobar assembly 50 is located at a 9-o'clock position relative to applicator roll 48 (as best shown in FIG. 3).

The illustrated embodiment of the isobar assembly 50 includes a frame member 64 and first and second metering rod assemblies 66, 68. The frame member 64 is relatively stiff and is mounted on the glue machine 38 for rotation about a central axis 70 over at least 180 degrees. Therefore, the frame member 64 can be rotated from the position illustrated to a position of opposite orientation. The metering rod assemblies 66, 68 are mounted on opposite sides of the frame member with the first assembly on the side facing the applicator roll 48 and the second assembly on the side facing away from the applicator roll 48. It can be seen that when the frame member 64 is rotated 180 degrees, the position of the assemblies 66, 68 is reversed; that is, with the second assembly 68 on the side facing the applicator roll 48 and the first assembly 66 on the side facing away from the applicator roll 48. Optionally, isobar assembly 50 can have additional metering rod assemblies, e.g. spaced on all four sides of the frame member 64 offset by 90-degree angles (not shown). In this embodiment, it will be understood that the frame member 64 would rotate about axis 70 in 90-degree intervals to sequentially place the respective metering rod assemblies in the operative position adjacent the applicator roll 48.

In instances where it is necessary to use two (or more) different types or thicknesses of adhesives which require different isobar structures, the first and second assemblies 66, 68 (and third, fourth, etc. if provided) are each selected to be suitable with one of the two (or several) adhesives. When the adhesive is changed, requiring a different isobar structure, the isobar assembly 50 is rotated to place the appropriate metering rod assembly in the operative position as described above.

In instances where it is not necessary to change adhesives, the additional assemblies (e.g. assembly 68 in FIG. 3) can be spare or backup assemblies. In the event that the first assembly 66 wears or becomes unsatisfactory for any reason, the isobar assembly 50 is rotated 180 degrees so that the second assembly 68 is pivoted into the operative position without delay.

The metering rod assemblies 66, 68 are substantially identical in structure, and each includes a channel member 72, a holder 74, a tubular pressure-tight bladder 76, and an isobar or metering rod 78. The channel member 72 is secured to the side of the frame member 64 and forms a longitudinally extending channel. The holder 74 has a projection on an inner side and a groove on an outer side. The projection is sized and shaped to extend into the channel so that the holder 74 is moveable toward and away from the frame member 64 within the channel member 72. The groove is sized and shaped for receiving the metering rod 78 so that the metering rod 78 is mounted in and supported by the holder 74.

The bladder 76 is positioned between the holder 74 and the channel member 72 within the channel of the member 72. Fluid pressure, preferably air pressure, is applied to the bladder 76 of the active metering rod assembly which is the assembly in the operative position adjacent the applicator roll 48 (assembly 66 in FIG. 3). The fluid pressure within the bladder 76 produces a force urging the holder 74 and the associated metering rod 78 toward the outer peripheral surface of the applicator roll 48. It should be noted that the force produced by the bladder 76 is uniform along the entire length of the metering rod 78.

It is important for the metering rod 78 to be supported such that the metering rod 78 is not deflected up or down with respect to the applicator roll 48 as a result of the hydraulic pressure; i.e. the metering rod 78 is urged toward the applicator roll 48 such that the metering rod axis 79 and the applicator roll axis 54 remain substantially coplanar in a horizontal plane during operation as shown in FIG. 3. The hydraulic pressure is a function of applicator roll speed and adhesive viscosity, among other things. The metering rod 78 and the holder 74 are sized such that they are flexible under the hydraulic forces encountered and therefore are not displaced from hydraulic pressure. Because the pressure supplied from the bladder 76 establishes a uniform force along the entire length of the metering rod, however, there is no change in spacing between the outer peripheral surface of the applicator roll 48 and the metering rod 78 along its entire length. Therefore, the metering rod 78 is positioned to produce a uniform thickness or coating of adhesive on the outer peripheral surface of the applicator roll 48 along its entire length. This is true even if the frame member 64 deflects to some degree under loading from hydraulic pressure.

In conjunction with the isobar assembly 50 as above described, it is possible to use a glue with very high solids content, preferably at least 25, more preferably 27, most preferably 30, weight percent solids, balance water, compared to other conventional glue machines that do not use an isobar assembly as described. This enables application of a very thin, uniform glue coating 41 on the surface of the applicator roll 48 that will not saturate the flutes of a corrugated sheet 18 as they come into contact with the glue layer as described in detail below.

Figure 6:
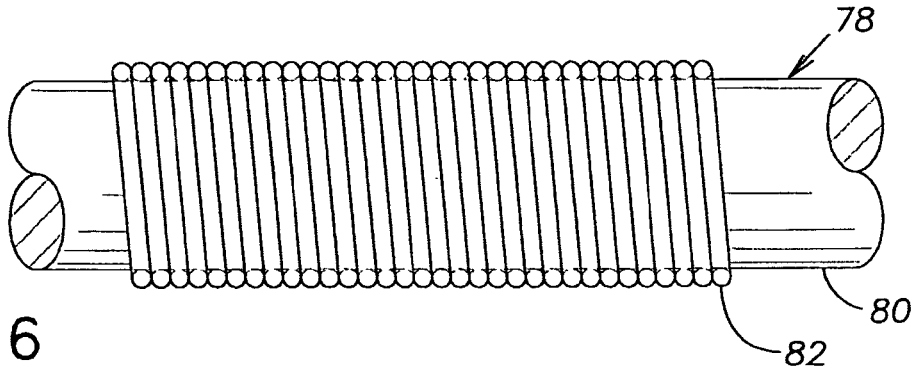
FIG. 6 is an enlarged fragmentary side view of an isobar metering device of the glue mechanism of FIG. 2.
Figure 6A:
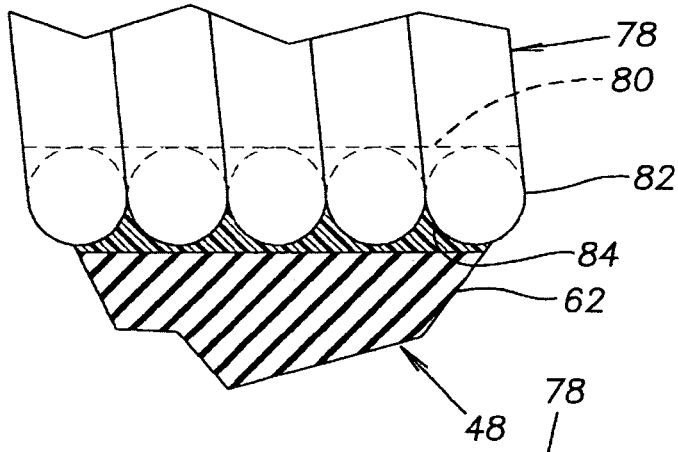
FIG. 6A is an enlarged fragmentary view at an interface between the isobar metering device and the applicator roll.

As best shown in FIGS. 6 and 6A, the isobar or metering rod 78 preferably includes a cylindrical rod 80 and spiral wound wire 82 thereon. The rod 80 extends the length of the applicator roll 48 and has a uniform diameter such as, for example about ⅝ of an inch. The wire 82 has a relatively small diameter such as, for example, of about 0.060 inches. The wire 82 is tightly spiral wound around the rod 80 in abutting contact along the length of the rod 80 to provide an outer surface, best illustrated in FIG. 6A, which forms small concave symmetrical cavities between the contact points of adjacent loops of wire 82. These small concave cavities 84 provide spaces with respect to the smooth outer surface of the applicator roll 48 so that small ridges of adhesive remain on the surface of the applicator roll 48 as the surface passes the metering rod 78.

It should be noted that even though adhesive on the outer surface of the applicator roll 48 tends to be in the form of ridges after it passes the metering rod 78, the adhesive tends to flow laterally and assume a uniform, flat and thin coating layer via cohesion. Of course, the viscosity of the adhesive in relation to the cohesion thereof determines the extent to which the adhesive coating becomes completely smooth. Preferably, the adhesive is a high-solids content adhesive as described above, having a viscosity of 15-55 Stein-Hall seconds.

The position of the isobar assembly 50 is adjustable toward and away from the applicator roll 48 to precisely set the gap therebetween (as indicated in FIG. 3). When the isobar assembly 50 is adjusted so that metering rod 78 is in virtual contact with the outer surface of the applicator roll 48, essentially all of the adhesive except that passing through the concave cavities between adjacent turnings of the wire 82, is removed from the outer surface of the applicator roll 48. On the other hand, when the metering rod 78 is spaced slightly away from the outer surface of the applicator roll 48 by reducing the pressure within the associated bladder 76, a coating of adhesive having greater thickness remains on the outer surface of the applicator roll 48. As indicated above, in a preferred embodiment the isobar assembly 50 is positioned with respect to the applicator roll 48 to provide a uniform adhesive coating on the outer surface having the preferred thickness for the desired flute size as explained above. It will be understood that the optimal position for the isobar assembly 50 will depend upon the viscosity, the solids content, and the surface tension of the adhesive being used, as well as the size of the flutes (e.g. A, B, C, E, etc.).

As best shown in FIG. 3, the metering rod 78 is mounted in and supported by the outer groove of holder 74 for rotation therein about its central axis 79. In operation, the metering rod 78 is rotated at a relatively high speed in the same direction as the rotation of the applicator roll 48 so that the metering rod 78 remains clean by throwing off excess adhesive. By rotating in the same direction as the applicator roll 48, excess adhesive is thrown in a downward direction back into the glue tray 46.

Figure 7:
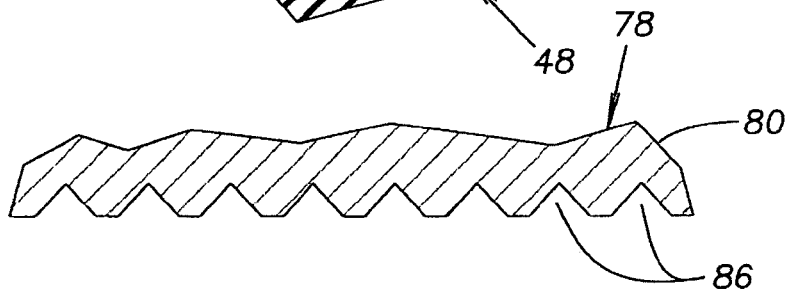
FIG. 7 is an enlarged fragmentary side view, similar to FIG. 6, of an alternative isobar metering device which may be used with the glue mechanism of FIG. 3.

As best shown in FIG. 7, the metering rod 78 can alternatively be a solid rod that has been machined to provide a grooved outer surface rather than having wire wound thereon. The machined outer surface preferably has inwardly extending cavities or grooves 86 which function similarly to the concave cavities 84 formed by the wire 82. The illustrated grooves 86 are axially spaced along the length of the metering rod 78 to provide a narrow flat section between the grooves 86. This variation of the metering rod 78 tends to remove a greater amount of adhesive and is typically used in applications where very thin coatings are required. Here again, the rod 78 is rotated to keep it from accumulating excess adhesive.

As best shown in FIG. 3, the rider roll 52 is journaled for rotation about a horizontal and transverse axis 87 in the direction opposite that of the applicator roll 48 and indicated by the arrow (counterclockwise) as viewed in FIG. 3. Preferably, the rider roll 52 is located at the forward or downstream side of the applicator roll 48 and with the axis 87 at the same height as the axis 54 of applicator roll 48; that is, the rider roll 52 is located at a 3-o'clock position relative to applicator roll 48 (as best shown in FIG. 3) opposite the isobar assembly 50. As such, the metering rod 78, the applicator roll 48, and the rider roll 52 are positioned at substantially the same elevation with the axes 79, 54, and 87 of the metering rod 78, the applicator roll 48, and the rider roll 52 respectively being substantially in the same horizontal plane (best shown in FIG. 3). Additionally, a vertically extending gap or space 88 is formed between the applicator roll 48 and the rider roll 52 for passage of the corrugation assembly 14 therethrough.

As best shown in FIG. 4, the position of the rider roll 52 is adjustable directly toward and away from the applicator roll 48 so that the width of the gap 88 can be precisely adjusted to control the degree to which the flutes 20 of the corrugation assembly 14 are compressed against the applicator roll 48 as they pass through gap 88. The degree of flute compression can be controlled to a high degree of accuracy because the rider roll 52 is linearly adjustable; that is, the rotational axis 87 of the rider roll 52 is movable directly toward and away from the rotational axis 54 of the applicator roll 48. Additionally, flexure of the rolls 48, 52 due to gravity does not affect the gap 88 because the gap 88 is vertical.

The gap 88 is preferably precisely closed and opened by a closed loop system including a motor and a linear transducer that moves the rider roll 52 toward and away from the applicator roll 48. Preferably, a pair of air cylinders can also open the gap between the rider roll 52 and the applicator roll 48 to a relatively large distance, such as about 4 inches, to meet various safety requirements.

Side to side accuracy of the precise gap, that is along the length of the rider roll 52, is maintained with two adjustment jacks and a cross-connecting shaft. The shaft transversely extends the length of the rider roll 52 and the adjustment jacks are located at or near the ends of the shaft so that the rider roll outer surface can be adjusted to be precisely parallel to the applicator roll outer surface. The cross-connecting shaft of the illustrated embodiment is a central shaft 89 of an idler roll 90 (best shown in FIG. 10) discussed in more detail below. It is noted, however, that the cross-connecting shaft could alternately be a central shaft in the rider roll 52.

Referring to FIG. 4A, a preferred method for applying adhesive to the crests of the flutes of a corrugated sheet 18 is shown. In this method, the position of the rider roll 52 is set to adjust the gap 88 between the rider roll 52 and the applicator roll 48 so that the flutes are compressed 3-30, preferably 5-15 or 5-10, percent of their initial flute height upon contact with the applicator roll 48. In other words, the flutes are compressed down to 70-97, preferably 85-95 or 90-95, percent of their initial flute height. As shown in FIG. 4A, a characteristic flute 150 has a leading sloped face 151, a trailing sloped face 152, and a crest 153. (Flute 150 in FIG. 4A is simply a characteristic flute 20 as it passes through the gap 88. The reference numeral 150 is used here instead of 20 merely for clarity to indicate a flute as it passes through the gap 88). In FIG. 4A, the notation a/b/c refers to the relative position of the characteristic flute 150; i.e. 150*a* refers to a position of the flute 150 on contact with the applicator roll 48, 150*b* refers to a position at the nip point in contact with the applicator roll 48 for wiping adhesive onto the flute 150, and 150*c* refers to a position following contact with the applicator roll 48. This a/b/c notation is used consistently in the following description with reference to FIG. 4A.

According to the present method, the web of the single-face corrugation assembly 14 carrying the flute 150 in FIG. 4 is traveling at a linear web speed, S, over the rider roll 52 in the gap 88 between that roll and the applicator roll 48. The applicator roll is rotated at an angular velocity (RPMs) such that based on the RPMs and the diameter of the applicator roll 52, the surface linear velocity of the applicator roll during operation of the glue machine is greater than the web speed, S, to provide glue to the exposed flute crests of the flutes 150 as the web traverses the gap 88. The surface linear velocity of the applicator roll 48 refers to the linear speed of the outer surface of the applicator roll 48, measurable in feet per minute. The surface linear velocity is related to the angular velocity (i.e. rotations per minute or RPMs) by the relation $v=2\pi r\Omega$; where v is the surface linear velocity in feet/min, r is the radius of the applicator roll 48 in feet, and $\Omega$ is the angular velocity of the applicator roll 48 in RPMs. The ratio of the surface linear velocity of the applicator roll 48 to the speed of the web carrying the flute 150 is referred to as the roll speed ratio. It will be appreciated that according to the invention, the roll speed ratio is greater than 100%; i.e. greater than 1. For all roll speed ratios herein, the surface linear velocity of the applicator roll 48 is greater than the web speed, S.

In one embodiment, the roll speed ratio is 105% to 200%. More preferably, the upper limit of that ratio is 150%, more preferably 140% or 130%. Alternatively, the upper limit can be 125%, 120%, 115% or 110%. By controlling the roll speed ratio, e.g. in the range of 105% to 130%, it has been found, surprisingly and unexpectedly, that substantially uniform glue application to the crests of flutes 150 can be achieved. Alternatively, roll speed ratios in the range of 130% to 150% also are preferred.

Without wishing to be bound by any particular theory, it is believed that uniform glue application is achieved for one or more of the following reasons, described with reference to FIG. 4A discussed above. As already noted, the position of the rider roll 52 can be set to adjust the gap 88 so the flutes are compressed a desired degree on contact with the applicator roll 48. As seen in FIG. 4A, the characteristic flute 150 is initially compressed on contact with the applicator roll 48 at position 150*a*. Because the applicator roll surface linear velocity is greater than the speed of the web that is carrying the flute, the surface of the applicator roll 48 engages the crest of flute 150*a* and drives it (compresses it) in a forward direction relative to the direction of travel of the web through the gap 88. At position 150*a*, the applicator roll 48 also wipes glue coated onto against the flute crest. Because the surface linear velocity of the roll 48 is greater than the speed of the web (and therefore the flute 150*a*), glue is wiped onto the flute 150*a* such that it pools in a region defined between the applicator roll surface and the trailing sloped face 152*a* of the flute 150*a*, near the crest 153*a*. As the flute 150*a* progresses to an intermediate position, 150*b*, the flute is even further compressed based on the width of the gap 88 and the above-noted pooling action continues to result in glue accumulation. Also at this point a quantity of glue from the pooled portion or from the surface of the applicator roll 48 (or both) is accumulated at the flute crest 153*b*, more adjacent the leading sloped face 151*b* of the flute 150*b*. Subsequently, as the flute 150*b* proceeds further and begins to emerge from contact and compression against the applicator roll 48 surface (shown in phantom in FIG. 4A), the greater velocity of the roll 48 surface tends to drag glue previously pooled adjacent the trailing sloped face up over the crest.

Essentially, by operating at roll speed ratios greater than 1, as the flute emerges from contact with the applicator roll 48 to proceed from 150*b* to 150*c*, glue from the trailing sloped face 151*b* is actually dragged forward by cohesive forces in a direction toward the crest 153*b*. Thus, at 150*c* there is substantially no glue remaining on the trailing sloped face 151*c* and all of the glue has been piled onto the crest 153*c*. Furthermore, because little or no glue is deposited to the leading sloped face at 152*b* due to its being compressed downward away from the applicator roll, none is present at 152*c*. The result is a flute at 150*c* following application of the adhesive that has glue only on the crest 153*c*, and substantially none on either the leading or trailing sloped faces 151*c* or 152*c*.

On emergence of the flute at 150*c*, the glue is substantially uniformly applied at the flute crest 153*c*. It will be appreciated that the glue's adhesive properties (adherence to the applicator roll surface) and cohesive properties (adherence to itself) probably play a roll in producing the above-noted dragging effect that results in a uniformly applied glue bead on the flute crest 153*c*. Both these properties may be enhanced compared to more conventional glue compositions based on the relatively high solids content that can be used for glue compositions according to the present invention, using the isobar assembly 50 to very precisely meter a thin glue film on the applicator roll surface.

Regardless of the actual mechanism, the ability to provide such a well metered glue bead at the flute crests using an applicator roll surface linear velocity greater than the web speed was a highly unexpected and surprising result. This is because based on the conventional wisdom, it was believed that relatively lower applicator roll surface velocities were necessary to achieve adequate wiping of glue from the applicator roll surface to the flute crests. Otherwise, it was believed accurate metering of glue could not be achieved because as the ratio of the two speeds (surface linear speed and web speed) approached unity, the only, known parameter for regulating glue application thickness (relative speed) was neutralized. Also, when using an isobar assembly 50 to meter the glue layer thickness on the applicator roll, the cavities 84 between adjacent turns of the wire 82 on the metering rod result in circumferential glue lines or ridges on the applicator roll surface. As noted above, the glue will tend to flow laterally, but complete lateral leveling often is not achieved by the time the applicator roll 48 has rotated 50% of its circumference based on operational speeds. As a result, the glue film still can have non-uniform peak and valley (ridge-like) characteristics along the length of the applicator roll surface. Glue wiping onto the flute crests based on a relatively slow applicator roll surface linear speed to solve the above problems was deemed necessary also to prevent applying glue "points" along the lengths of flute crests, as opposed to a uniform glue bead.

Operating the applicator roller at a higher surface linear velocity than the web speed was not considered an option in the conventional art. It was believed that doing so would result in excessive pooling of adhesive against the trailing faces of the flutes, which it was thought would lead to undesirable washboarding effects as described above. That a ratio of applicator roll surface linear velocity to web speed greater than 1 actually produces uniformly thick and well metered glue beads that can be applied with precision to the crests of flutes 150 was an extremely surprising and unexpected result.

It is noted that when operating at certain roll speed ratios (such as at least 125% or at least 130%), each subsequent flute passes over at least a portion of the preceding flute's path against the roll 48. The result is that the applicator roll 48 is wiped substantially clean of all of the glue thereon. This in turn results in a substantially linear relationship between roll speed and glue weight applied to the flute tips, with the glue weight being substantially uniform among the flute tips. This means that the amount of glue applied to the flute tips can be reliably and reproducibly controlled as a function of roll speed, particularly at relatively higher roll speed ratios, meaning ratios in the range of, say 125% to 150% or 160%. Much above these ratios, for example at roll speed ratios higher than about 160 to 180 percent, some glue from the applicator roll may tend to be dragged onto some of the flutes as they emerge from the gap 88 due to adhesive and cohesive forces, glue surface tension effects, and glue absorbency in the flute material. In that event, the applied glue weight may vary unpredictably and uncontrollably from flute to flute. For this reason it is contemplated that roll speed ratios much above these, for example greater than 200%, may be impractical.

In one example, it has been found that an adhesive coating 41 thickness on the outer surface of applicator roll 48 less than about 0.006 inches combined with a roll speed ratio of about 130% together result in the flutes being able to accept and absorb more glue, and the entire surface of the roll 48 being substantially wiped clean. Under these conditions, excellent glue weight control and reproducibility can be achieved.

Following contact with the applicator roll 48, the flute 150*c* rebounds to substantially its initial dimensions (height). Preferably, the flute 150*c* rebounds to at least 80, preferably at least 85, preferably at least 90, preferably at least 95, preferably at least 96, preferably at least 98, percent of its initial height. Near complete rebound is possible in the present invention because of the very thin, high-solids content adhesive coating 41 on the outer surface of applicator roll 48. Such a coating is achieved via the isobar assembly 50 as described above, and results in the flutes not becoming saturated with or absorbing a significant amount of water as they come into contact with the adhesive coating 41 on the surface of applicator roll 48.

The combination of a glue machine 38 as described above having an isobar assembly 50, and the described method of applying glue only to the crests of the flutes of a corrugated sheet 18, provides precise control of glue weight over a wide range while ensuring proper placement only on the flute crests. The adhesive has an even thickness and is symmetric about the crest 153*c* of the flute 150*c* with sharply defined edges resulting in both a reduction in the amount of adhesive used and a maximum bonding strength.

The result is a finished corrugated cardboard product having superior surface appearance with substantially no washboarding, and superior and uniform impact and crush strength independent of direction.

The size of the rider roll 52 is preferably minimized to as small as practically possible. The minimized size of the rider roll 52 reduces the number of the flutes 20 of the corrugation assembly 14 that are in contact with the adhesive coating at one time, and thus reduces the dwell time in which the flutes 20 are in contact with the adhesive coating as discussed below in more detail.

Figure 9:
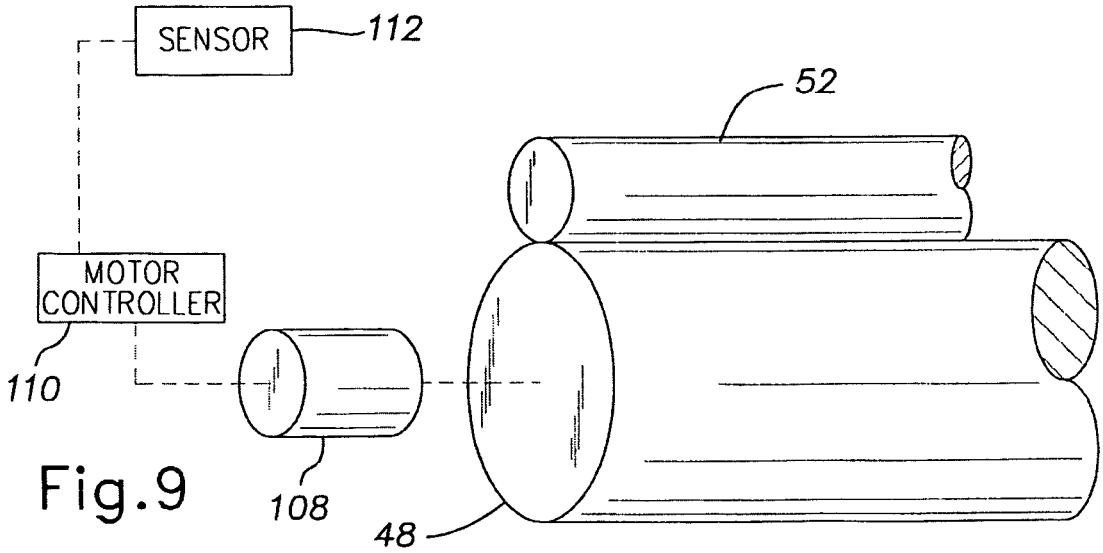
FIG. 9 is a schematic view of a drive system for driving the applicator roll and for controlling the speed thereof.

FIG. 9 schematically illustrates a drive system for the applicator roll 48. A variable speed motor 108 is connected to the applicator roll 48 and provides power to rotate the applicator roll 48 during the operation of the machine 10. An electronic control 110 is connected to the motor 108 and adjustably controls the rotational speed of the applicator roll 48. This ability to control the speed of the roll 48 is an important feature of the present invention because it allows adjustment of the applicator roll surface linear velocity relative to the velocity of the corrugation assembly 14 (and therefore corrugated sheet 18) as described above. This provides the very precise control of the transfer of adhesive from the applicator roll 48 to the flutes 20 of the corrugation assembly 14.

Because the gap 88 between the applicator roll 48 and the rider roll 52 is vertical, gravity pulls straight down on the glue layer at the nip point of the gap 88 so that the amount of glue applied is directly proportional to the rotational speed of the applicator roll 48. Therefore, changes in glue coating 41 thickness on the applicator roll 48 are no longer necessary for controlling the amount of glue applied to the corrugation assembly 14 or coating weight control. The coating weight can be automatically controlled by connecting a glue weight sensor 112 to the motor controller 110 so that the controller 110 automatically adjusts the speed of the applicator roll 48 until the weight detected by the sensor 112 is equal to a desired amount. Furthermore, by using a high-solids content glue and compressing the flutes 3-30 (preferably 5-15) percent of their initial height as above-described, it is now possible to adjust the applicator roll 48 speed across a far greater range than was previously possible while still providing glue only on the crests of the flutes 20.

It is noted that as the speed of the applicator roll 48 is increased relative to the rider roll 52, the amount of glue applied to the corrugation assembly 14 (flute crests) is increased. As described above, large roll speed ratios enable the flutes 20, 150 to receive a more controlled and smaller amount of adhesive and enables the flutes 20, 150 to remove virtually all of the adhesive from the applicator roll 48 to reduce over spray.

Figure 10:
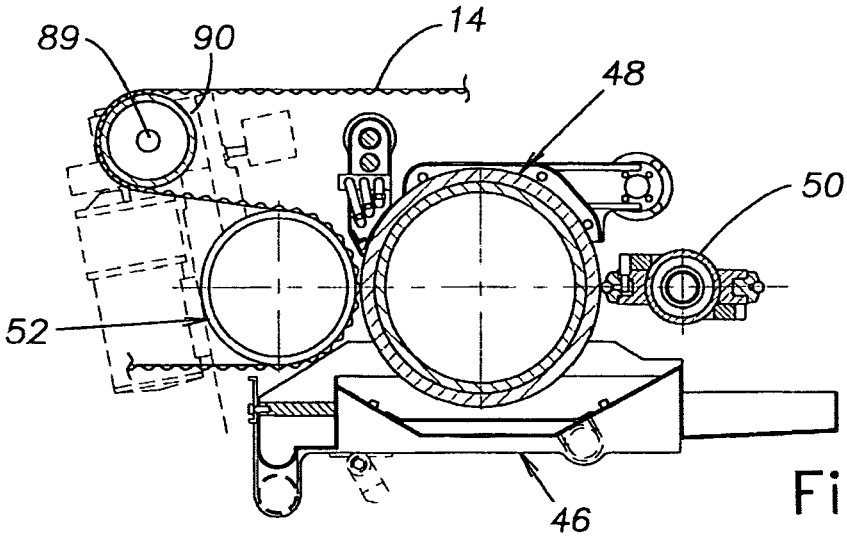
FIG. 10 is a fragmentary elevational view, partially in cross-section, similar to FIG. 2 but viewed from the opposite side and showing additional features of a rider system of the glue mechanism.

As best shown in FIG. 10, the idler roll 90 is arranged so that the corrugation assembly 14 is substantially tightly wrapped around the circumference of the rider roll 52, particularly, in the area of the gap 88 between the applicator roll 48 and the rider roll 52. Such an arrangement reduces the number of flutes 20 in contact with the adhesive layer and thus the dwell time during which the flutes 20 of the corrugation assembly 14 are in contact with the adhesive layer as discussed in more detail below. The corrugation assembly 14 preferably wraps around at least 30 percent of the periphery of the rider roll 52, and more preferably wraps around about 50 percent, that is about 180 degrees, of the periphery of the rider roll 52. In the illustrated embodiment, the idler roll 90 is positioned on the forward side of the rider roll 52 so that the corrugation assembly moves in a generally S-shaped pathway around the idler roll 90 and the rider roll 52.

The idler roll 90 is preferably carried by an arm assembly that moves the rider roll 52 so that the idler roll 90 and rider roll 52 are rigidly connected together. As a result, the idler roll 90 moves with rider roll 52 as the rider roll 52 is moved to adjust the precisely controlled gap 88. Therefore, there is no change in the length of the web path if the width of gap 88 is changed or the position of the glue machine 38 is moved.

Figure 11:
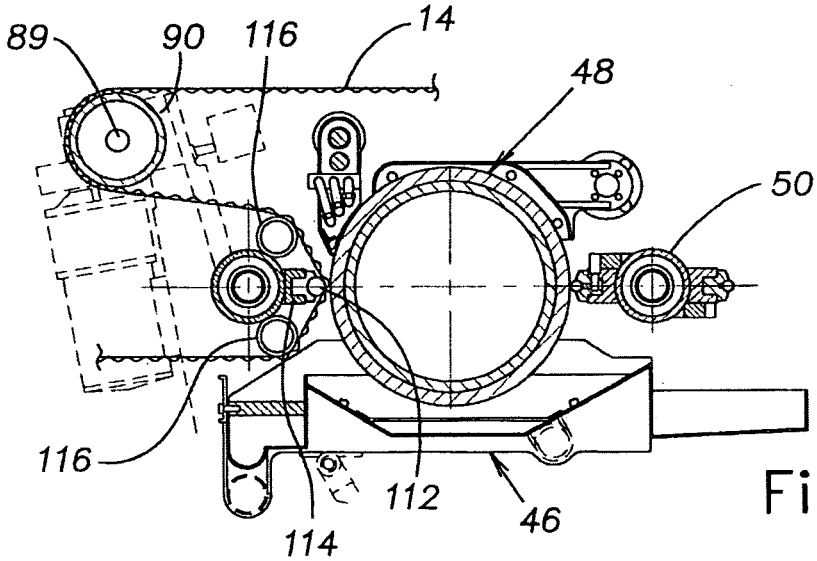
FIG. 11 is a fragmentary elevational view, partially in cross-section, similar to FIG. 10 but showing an alternative embodiment of the rider system.
Figure 12:
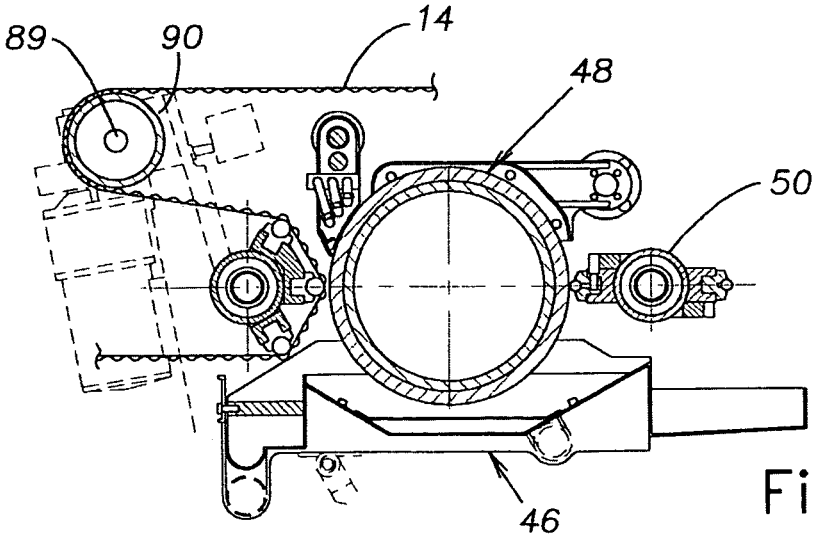
FIG. 12 is a fragmentary elevational view, partially in cross-section, similar to FIGS. 10 and 11 but showing another alternative embodiment of the rider system.

As best shown in FIGS. 11 and 12, alternate embodiments of the rider system can be utilized within the scope of the present invention to even further reduce the number of flutes 20 in contact with the glue layer and thus the dwell time. As shown in FIG. 11, the rider system can be a relatively small diameter rod 112 supported by a rod holder 114. The rod holder 114 can have a structure similar to the metering rod assemblies described above in detail. The rod 112 is preferably positioned between a pair of idler rolls 116 arranged to direct the corrugation assembly 14 to and from the rod 112. The rod 112 is an extremely small sized rider roll which operates as described in detail hereinabove with regard to the rider roll 52 of the first embodiment. The rod 112, however, provides an extremely small diameter compared to typical rider rolls. The rod 112 can have a diameter of less than 3 inches, for example 1.5 inches.

As shown in FIG. 12, the rider system can alternatively include three of the relatively small rods 112 supported by three of the rod holders 114. The two additional rods 112 function as and replace the idler rolls 116 discussed above with regard to the embodiment of FIG. 11.

During operation of the glue machine 10, the applicator roll 48 rotates and picks-up adhesive from the glue pan 46 onto the smooth peripheral outer surface of the applicator roll 48. As the adhesive rotates past the isobar assembly 50, the metering rod 78 removes excess adhesive from the outer surface of the applicator roll 48 and leaves a precisely controlled extremely thin layer of adhesive coating 41 on the outer surface of the applicator roll 48. As the applicator roll 48 continues to rotate, the precisely controlled adhesive coating 41 travels from the isobar assembly 50 to a position adjacent the gap 88; that is, the location where the flutes 20 of the corrugation assembly engage the applicator roll 48 as previously described.

The rider roll 52 rotates in a direction opposite the applicator roll 48. The first face sheet 22 smoothly engages the outer surface of the rider roll 52 and is held substantially against slippage relative thereto.

As the flutes 20 of the corrugation assembly 14 pass through the nip point of the precisely controlled vertical gap 88 between the applicator roll 48 and the rider roll 52, the flutes come into contact with the thin coating 41 of adhesive and/or the applicator roll 48 as described above.

Because the corrugation assembly 14 is substantially wrapped around the rider roll 52 and/or the size of the rider system is minimized, the flutes 20 contact the adhesive coating 41 and/or the applicator roll 52 only at the nip point of the gap 88 so that they are wetted with adhesive and compressed at essentially the same time. Preferably, only 1 to 2 flutes 20 are in contact with the adhesive and/or the applicator roll 48 at any given time. No presoaking or post soaking of the flutes 20 occurs; that is, the flutes 20 do not touch the adhesive before reaching the nip point or after leaving the nip point. Therefore the dwell time, the time for which the flutes 20 are in contact with the adhesive and/or the applicator roll 48, is minimized so that the flutes 20 remain as resilient as possible.

As the flutes 20 pass through the nip point of the vertical gap 88, the thin coating 41 of adhesive on the applicator roll 48 is transferred to the crests of the flutes 20. Any spray of adhesive generated at the nip point is downwardly directed without a horizontal velocity component. Therefore, no adhesive is sprayed outside the glue tray 46, which is located directly below the nip point, even at high speeds. Additionally, gravity eliminates any pooling problems of the adhesive because gravity pulls the adhesive straight down at the nip point.

The combination of a) metering a very thin layer of adhesive on the applicator roll 48, b) maintaining a precise and adjustable vertical gap 88 between the applicator roll 48 and the rider roll 52, c) eliminating pre-nip and post-nip soaking of the flutes 20 in the thin layer of adhesive, and d) compressing the flutes 3-30 (most preferably 5-15) percent of their initial height at the nip point, allows the surface linear velocity of the applicator roll 48 to be greater than the web speed, S, for example roll speed ratio greater than 105% or at least 130%, with no discernable snow plow effects, and without applying glue to the leading or trailing sloped faces of the flutes 20. Additionally, the amount of glue consumed is dramatically reduced because of minimized spray and stringing of the adhesive. Furthermore, the glue is precisely positioned on the tip of the flutes so that the final product has a maximum caliper and an extremely smooth outer surface finish.

With the present invention it is possible to efficiently apply virtually any type of hot or cold adhesive and obtain maximum strength in the finished product while applying substantially less adhesive per unit of area of the finished product.

Although particular embodiments of the invention have been described in detail, it will be understood that the invention is not limited correspondingly in scope, but includes all changes and modifications coming within the spirit and terms of the claims appended hereto.

What is claimed is:

1. A method of applying adhesive to flutes of a corrugated sheet, each said flute having a leading sloped face, a trailing sloped face and a crest, said method comprising the steps of:

a) applying a layer of adhesive on an outer surface of an applicator roll and rotating said applicator roll in a first direction; and b) moving said corrugated sheet along a path adjacent said outer surface of said applicator roll to apply adhesive to said flutes from said layer of adhesive;

wherein a roll speed ratio is defined as the ratio of the surface linear velocity of said applicator roll to the speed at which said corrugated sheet is moving, said roll speed ratio being greater than 1.

2. A method according to claim 1, further comprising the step of:

c) compressing said flutes down to 70-97% of their initial height against said applicator roll.

3. A method according to claim 2, wherein said flutes are compressed down to 85-95% of their initial height.

4. A method according to claim 2, wherein said flutes are compressed down to 90-95% of their initial height.

5. A method according to claim 2, wherein said flutes rebound to at least 95% of their initial height following compression thereof.

6. A method according to claim 2, wherein said flutes rebound to at least 98% of their initial height following compression thereof.

7. A method according to claim 1, wherein on initially contacting each said flute with said applicator roll, the crest of each said flute is compressed in a forward direction relative to the direction in which said corrugated sheet is moving along said path adjacent said outer surface of said applicator roll.

8. A method according to claim 7, wherein glue is pooled in a region defined between the applicator roll surface and the trailing face of the flute near the crest thereof when said flute crest is compressed in said forward direction, and wherein glue is drawn from said pooled region toward the crest of said flute from adhesive and cohesive forces in the glue as a respective result of the surface linear velocity of the applicator roll being greater than the speed of the corrugated sheet.

9. A method according to claim 1, further comprising the steps of:

rotating a rider roll in a second direction opposite said first direction of said applicator roll, said rider roll and said applicator roll each having a rotational axis, said rotational axes being substantially parallel to one another;

positioning said rider roll in a position adjacent said applicator roll to provide a gap therebetween, said path of said corrugated sheet proceeding through said gap; and adjusting said position of said rider roll relative to said applicator roll to set a width of said gap and thereby to regulate a degree of compression of said flutes against said applicator roll.

10. A method according to claim 9, wherein said gap width is adjusted so that said flutes are compressed down to 70-97% of their initial height against said applicator roll.

11. A method according to claim 9, wherein said gap width is adjusted so that said flutes are compressed down to 85-95% of their initial height against said applicator roll.

12. A method according to claim 9, wherein said rotational axes of said applicator roll and said rider roll are substantially coplanar in the same horizontal plane.

13. A method according to claim 1, said roll speed ratio being at least 105%.

14. A method according to claim 1, said roll speed ratio being in the range of 105% to 130%.

15. A method according to claim 1, said roll speed ratio being at least 130%.

16. A method according to claim 1, said roll speed ratio being in the range of 130% to 150%.

17. A method according to claim 1, wherein said adhesive is at least 27 weight percent solids, balance water.

18. A method according to claim 1, wherein said adhesive is at least 30 weight percent solids, balance water.

19. A method according to claim 1, wherein said adhesive is at least 30 weight percent solids, balance water, and said adhesive layer has a thickness of 0.008 inches or less.

20. A method according to claim 1, said adhesive layer having a thickness of 0.006 inches or less.

21. A method according to claim 1, wherein said adhesive layer on said applicator roll is a uniform adhesive coating provided by a metering rod held in position against said applicator roll outer surface at a position subsequent to a coating position of said applicator roll, said metering rod removing excess glue from said outer surface of said applicator roll to provide said uniform adhesive coating.

22. A method according to claim 21, wherein said metering rod is adjusted by an isobar assembly to provide a desired thickness of said adhesive coating on said outer surface of said applicator roll, said isobar assembly comprising a metering rod assembly for holding said metering rod, said metering rod assembly including a channel member, a holder, and a tubular pressure-tight bladder therebetween, said channel member forming a longitudinally extending channel, said holder extending into said channel and being moveable toward and away from said applicator roll within said channel member, said holder having a groove therein for retaining said metering rod therein.

23. A method according to claim 1, said adhesive having a viscosity of 15-55 Stein-Hall seconds.

24. A method according to claim 1, wherein only 1-2 of said flutes are in contact with said applicator roll and/or said adhesive layer at one time.

25. A method of applying adhesive to flutes of a corrugated sheet, each said flute having a leading sloped face, a trailing sloped face and a crest therebetween, said method comprising the steps of:

a) applying a layer of adhesive on an outer surface of an applicator roll and rotating said applicator roll in a first direction;

b) moving said corrugated sheet along a path adjacent said outer surface of said applicator roll to apply adhesive to said flutes from said layer of adhesive; and c) initially contacting each said flute with said applicator roll such that the crest of each said flute is compressed in a forward direction relative to the direction in which said corrugated sheet is moving along said path adjacent said outer surface of said applicator roll.

26. A method according to claim 25, further comprising the step of:

d) compressing said flutes down to 70-97% of their initial height against said applicator roll such that said leading sloped face of each said flute is bent forward and shielded from contact with said applicator roll.

27. A method according to claim 25, wherein a roll speed ratio is defined as the ratio of the surface linear velocity of said applicator roll to the speed at which said corrugated sheet is moving, said roll speed ratio being in the range of 105% to 200%.

28. A method according to claim 27, said roll speed ratio being at least 130%.

29. A method according to claim 25, wherein each said flute rebounds to at least 98% of its initial height after having adhesive applied thereto from said applicator roll.

* * * * *

UNITED STATES PATENT AND TRADEMARK OFFICE

CERTIFICATE OF CORRECTION

PATENT NO. : 7,595,086 B2
APPLICATION NO. : 11/259794
DATED : September 29, 2009
INVENTOR(S) : Herbert B. Kohler It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 883 days.

Signed and Sealed this

Twenty-eighth Day of September, 2010

David J. Kappos

David J. Kappos
*Director of the United States Patent and Trademark Office*